US009897974B2

(12) United States Patent
Nicolas et al.

(10) Patent No.: US 9,897,974 B2
(45) Date of Patent: Feb. 20, 2018

(54) WATCH BRACELET

(71) Applicant: Omega SA, Biel/Bienne (CH)

(72) Inventors: Cedric Nicolas, Neuchatel (CH); Dimitri Fostinis, Moutier (CH)

(73) Assignee: Omega SA, Biel/Bienne (CH)

( * ) Notice: Subject to any disclaimer, the term of this patent is extended or adjusted under 35 U.S.C. 154(b) by 0 days.

(21) Appl. No.: 15/308,632

(22) PCT Filed: May 31, 2016

(86) PCT No.: PCT/EP2016/062275

§ 371 (c)(1),
(2) Date: Nov. 3, 2016

(87) PCT Pub. No.: WO2016/202576

PCT Pub. Date: Dec. 22, 2016

(65) Prior Publication Data

US 2017/0185044 A1 Jun. 29, 2017

(30) Foreign Application Priority Data

Jun. 19, 2015 (EP) ..... 15172993

(51) Int. Cl.

| | |
|---|---|
| ***G04B 37/14*** | (2006.01) |
| ***A44C 5/14*** | (2006.01) |
| ***G04G 17/06*** | (2006.01) |

(52) U.S. Cl.

CPC ..... *G04B 37/1486* (2013.01); *A44C 5/14* (2013.01); *G04G 17/06* (2013.01)

(58) Field of Classification Search

CPC .... G04B 37/1486; G04B 17/06; G04B 37/14; G04G 17/04; G04G 17/045; A44C 5/14; A44C 5/147

See application file for complete search history.

(56) References Cited

U.S. PATENT DOCUMENTS 6,619,836 B1 9/2003 Silvant et al.
7,081,905 B1 * 7/2006 Raghunath ..... G04G 5/00 345/684

(Continued)

FOREIGN PATENT DOCUMENTS

EP 2560303 A1 2/2013
FR 2641092 A1 6/1990

(Continued)

OTHER PUBLICATIONS

International Search Report dated Sep. 8, 2016, in PCT/EP2016/062275, filed May 31, 2016 (with Translation of Category of Cited Documents in attached foreign language Search Report).

*Primary Examiner* — Sean Kayes
(74) *Attorney, Agent, or Firm* — Oblon, McClelland, Maier & Neustadt, L.L.P.

(57) ABSTRACT

A watch including a bracelet or strap and a watch case, the bracelet including a first arm in which is housed a first printed circuit portion and a second arm in which is housed a second printed circuit portion, the first arm being connected to the second arm via a median part configured to act as a seat for the watch case and which includes a mechanism ensuring electrical continuity between the first printed circuit portion and the second printed circuit portion. The first and second printed circuit portions carry at least one electronic component and an electrical energy source supplying the electronic component with electrical current.

21 Claims, 6 Drawing Sheets

(56) References Cited

U.S. PATENT DOCUMENTS

| | | | | |
|---|---|---|---|---|
| 7,618,260 | B2 * | 11/2009 | Daniel | A44C 5/0007 24/311 |
| 9,292,008 | B1 * | 3/2016 | Ahamed | G06F 1/163 |
| 9,581,972 | B1 * | 2/2017 | Arrow | H02J 7/0044 |
| 9,693,609 | B2 * | 7/2017 | Rohrbach | A44C 5/08 |
| 9,723,899 | B2 * | 8/2017 | Modaragamage | A44C 5/24 |
| 2007/0279852 | A1 * | 12/2007 | Daniel | A44C 5/0007 361/679.03 |
| 2012/0194976 | A1 | 8/2012 | Golko et al. | |
| 2014/0194061 | A1 | 7/2014 | Fine | |
| 2014/0313128 | A1 | 10/2014 | Golko et al. | |
| 2015/0085623 | A1 | 3/2015 | Modaragamage | |
| 2015/0164189 | A1 * | 6/2015 | Wilson | A44C 5/14 224/164 |
| 2015/0378312 | A1 | 12/2015 | Modaragamage | |
| 2016/0062392 | A1 * | 3/2016 | Townsend | G06F 1/163 361/679.03 |

FOREIGN PATENT DOCUMENTS

| | | | |
|---|---|---|---|
| WO | 01/35173 | A1 | 5/2001 |
| WO | 2013/156117 | A1 | 10/2013 |

* cited by examiner

WATCH BRACELET

FIELD OF THE INVENTION

The present invention concerns a watch bracelet or strap. More specifically, the invention concerns a watch bracelet in which are housed one or more electronic components arranged to perform at least one electronic function.

BACKGROUND OF THE INVENTION

There is a strong trend in the current market relating to connected watches having one or more electronic functions and capable of communicating, for example, with mobile telephones of the smart phone type. In the case of connected watches, the emphasis is, however, placed more on the range of electronic functions that such watches offer their users than on the aesthetic, timekeeping and sealing qualities of such watches. The connected watches currently available on the market are thus unattractive and relatively fragile objects whose daily use requires a great deal of care on the part of the user.

SUMMARY OF THE INVENTION

It is an object of the present invention to overcome the aforementioned problems in addition to others, by providing a bracelet or strap that will enable one or more electronic functions to be associated with a watch case.

To this end, the present invention concerns a watch bracelet comprising a first bracelet strand in which is housed a first printed circuit sheet and a second bracelet strand in which is housed a second printed circuit sheet, the first bracelet strand being connected to the second bracelet strand via a median part arranged to act as a seat for a watch case and which includes means for ensuring electrical continuity between the first printed circuit sheet and the second printed circuit sheet, at least one of the first or second printed circuit sheets carrying at least one electronic component and the other printed circuit sheet carrying at least one electrical energy source supplying the electronic component with electrical current.

According to an additional feature of the invention, the first printed circuit sheet, the second printed circuit sheet and the median part, which includes the means for ensuring electrical continuity between the first printed circuit sheet and the second printed circuit sheet, are made in one piece.

According to another feature of the invention, the first printed circuit sheet and the second printed circuit sheet are overmoulded with a first plastic material.

According to yet another feature of the invention, the median part is overmoulded with the first plastic material.

According to yet another feature of the invention, the median part is covered by an insert.

According to an additional feature of the invention, the bracelet, which is formed of the first and second printed circuit sheets overmoulded with the first plastic material and of the median part which is covered by the stiff insert, is overmoulded with a second plastic or elastomeric material or inserted in a sleeve.

According to an additional feature of the invention, the sleeve is made in one piece or is formed of an upper band and a lower band joined to each other along their peripheral edges.

According to an additional feature of the invention, the watch case includes two pairs of diametrically opposite horns and the stiff insert includes two guide elements, which are arranged to be placed between the respective pairs of horns and each pierced with a hole for the passage of a pin to enable the bracelet to be attached to the watch case.

As a result of these features, the present invention provides a bracelet in which are housed the electronic components necessary to execute at least one electronic function and which is attached to a watch case containing a watch movement. This watch movement may be an electronic movement, a mechanical movement or a combination of two such movements. In any event, the watch case that contains the watch movement is not affected by the addition of the bracelet according to the invention which enables one or more electronic functions to be executed. The aesthetic, sealing and timekeeping properties of the watch case thus remain intact while offering the user additional electronic functions, owing to the addition of the bracelet of the invention.

If the bracelet is worn out or if the electrical energy source that it contains is exhausted, it can easily be exchanged for a new bracelet. Of course, according to a variant, the electrical energy source may also be rechargeable. It is also possible to envisage producing bracelets arranged to perform different electronic functions, allowing the user the possibility of choosing the bracelet that offers the electronic function that meets his requirements, or of purchasing several different bracelets at the same time.

According to an additional advantage of the invention, the fact that printed circuit sheets are disposed in the two bracelet strands and that these printed circuit sheets are also electrically connected to each other means it is possible to increase the number of electronic components housed inside the bracelet and thus to increase the number of electronic functions available to the user, or to distribute the electronic components in an optimum manner between the two bracelet strands.

BRIEF DESCRIPTION OF THE DRAWINGS

Other features and advantages of the present invention will appear more clearly from the following detailed description of one embodiment of the bracelet according to the invention, this example being given solely by way of non-limiting illustration with reference to the annexed drawing, in which.

DETAILED DESCRIPTION OF ONE EMBODIMENT OF THE INVENTION

The present invention proceeds from the general inventive idea which consists in associating a watch case containing a watch movement, preferably but not limited to a mechanical movement, with a bracelet, in the thickness of which are housed the electronic component(s) necessary for the execution of at least one electronic function. As a result of these features, it is possible for the aesthetic appearance, mechanical properties and timekeeping qualities of the watch case to remain unchanged while adding thereto one or more additional electronic functions which will convert such a watch into a connected watch. The present invention is particularly advantageous in the case of a mechanical movement, since it can maintain the emotional aspect of a mechanical movement while increasing the range of services that such a watch is capable of providing its user.

Figure 1:
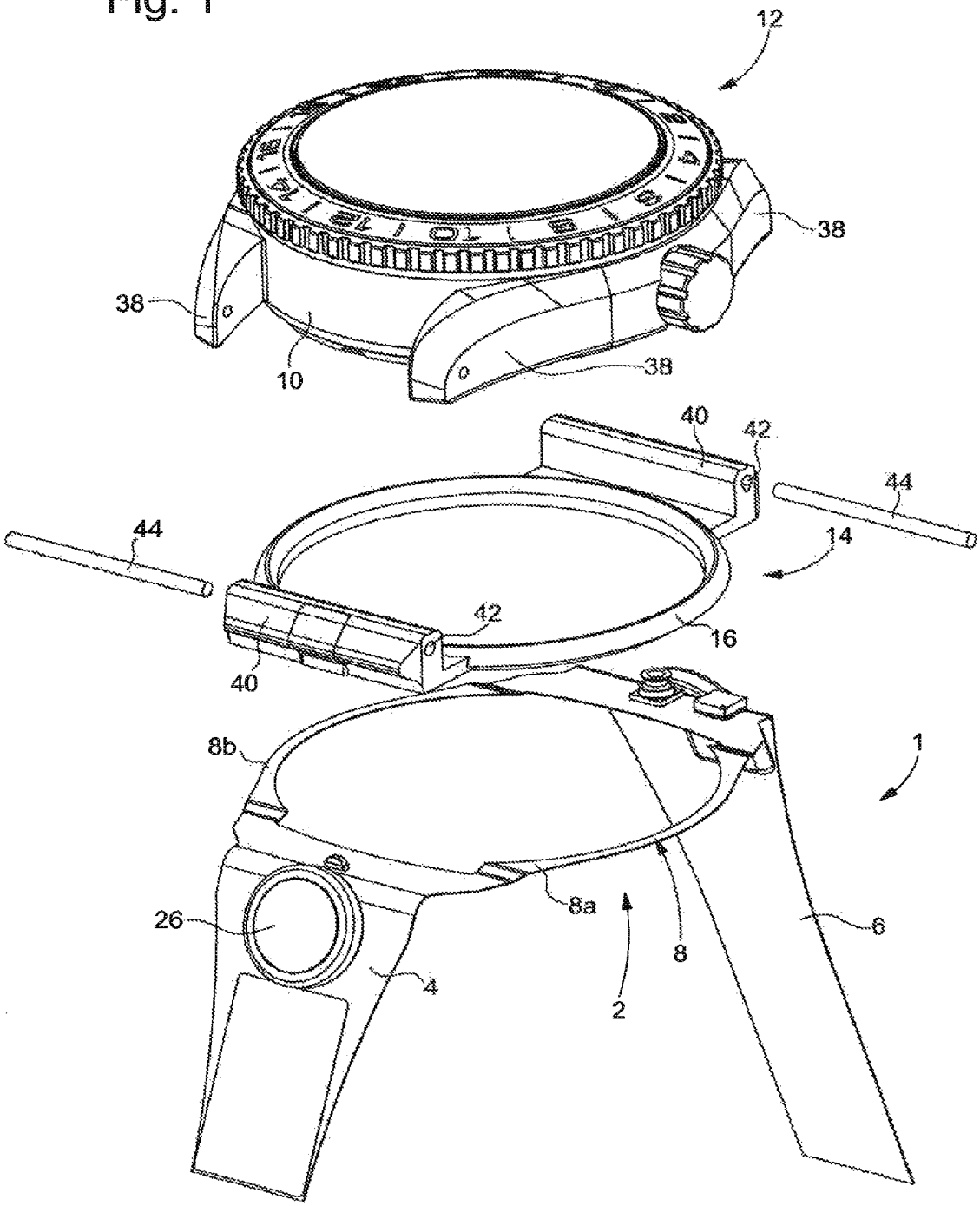
FIG. 1 is a perspective view of the bracelet according to the invention wherein a first printed circuit sheet is connected to a second printed circuit sheet via a median part arranged to act as a seat for a watch case, this median part including means for ensuring electrical continuity between the first printed circuit sheet and the second printed circuit sheet and being covered by a stiff insert.
Figure 2:
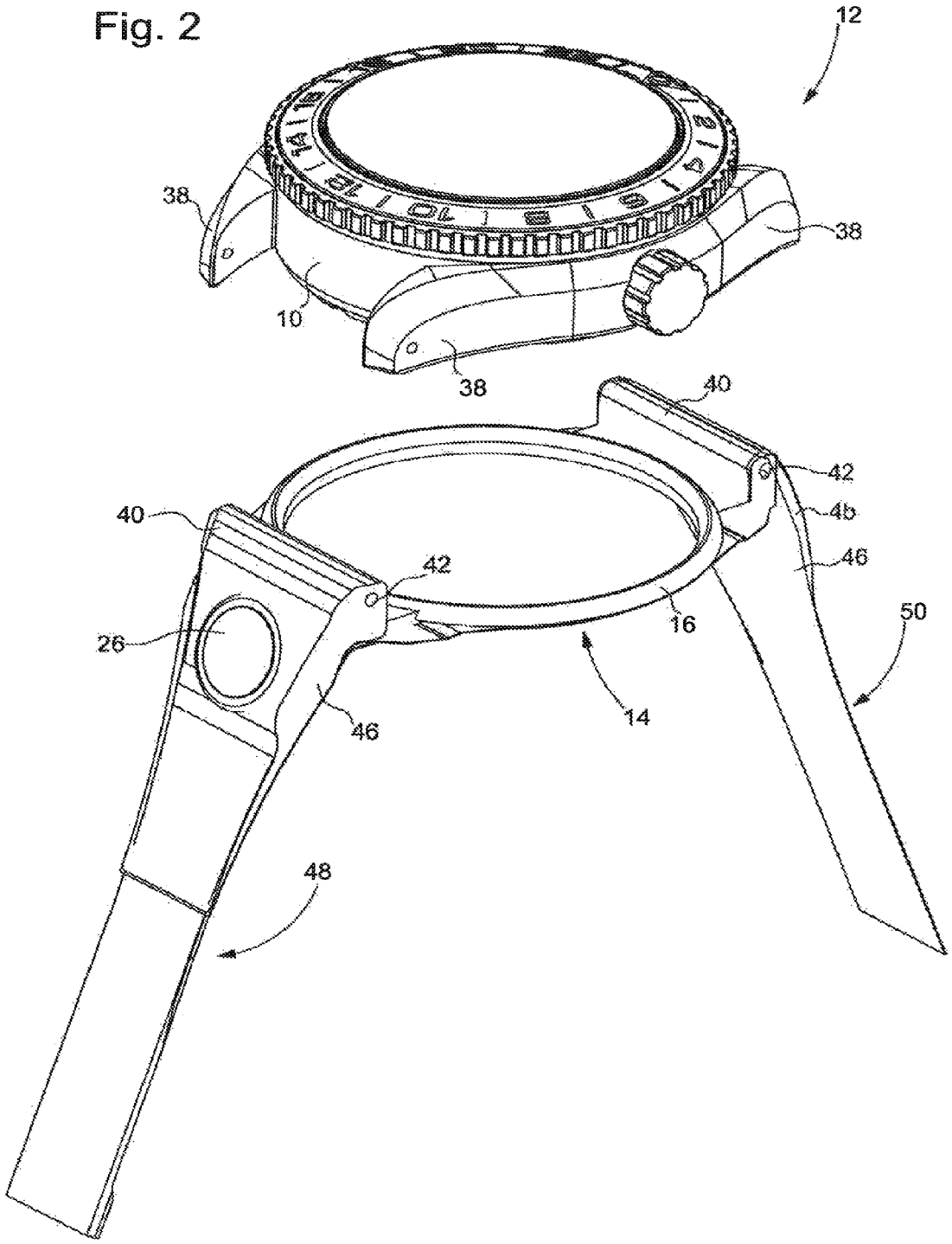
FIG. 2 is a similar view to that of FIG. 1 wherein the first printed circuit sheet and the second printed circuit sheet are overmoulded with a first plastic or elastomeric material.

FIG. 1 is a perspective view of the bracelet according to the invention. Designated as a whole by the general reference numeral 1, this bracelet includes a printed circuit sheet 2 formed of a first printed circuit portion 4, connected to a second printed circuit portion 6, via a median part 8 which includes means for ensuring electrical continuity between first printed circuit portion 4 and second printed circuit portion 6.

Median part 8 could be separate from first and second printed circuit portions 4 and 6. In such case, additional electrical connection means such as wires would have to be provided between first printed circuit portion 4 and median part 8, and between median part 8 and second printed circuit portion 6, which is not necessarily very convenient. This is why, according to the preferred embodiment of the invention, first printed circuit portion 4, median part 8 and second printed circuit portion 6 are made in one piece. Median part 8 will thus also be formed of a printed circuit sheet portion on which electrically conductive path(s) will be structured to ensure electrical continuity between the first and second printed circuit portions 4 and 6.

As is shown, in particular, in FIG. 1, median part 8, which is of approximately annular shape, is formed of two arches 8*a* and 8*b* that define an external diameter substantially corresponding to the external diameter of a case middle 10 of a watch case 12, which is intended to be arranged above median part 8 with the insertion of an insert 14 between watch case 12 and median part 8. This insert 14 includes a stiff ring 16 whose geometry is similar to that of median part 8 and which is attached to median part 8 by any appropriate means, such as adhesive bonding. This stiff ring 16 gives median part 8 stiffness and mechanical strength and acts as a seat for watch case 12. It is understood that, owing to its ring-shape, median part 8 leaves the back of watch case 12 visible.

Figure 3:
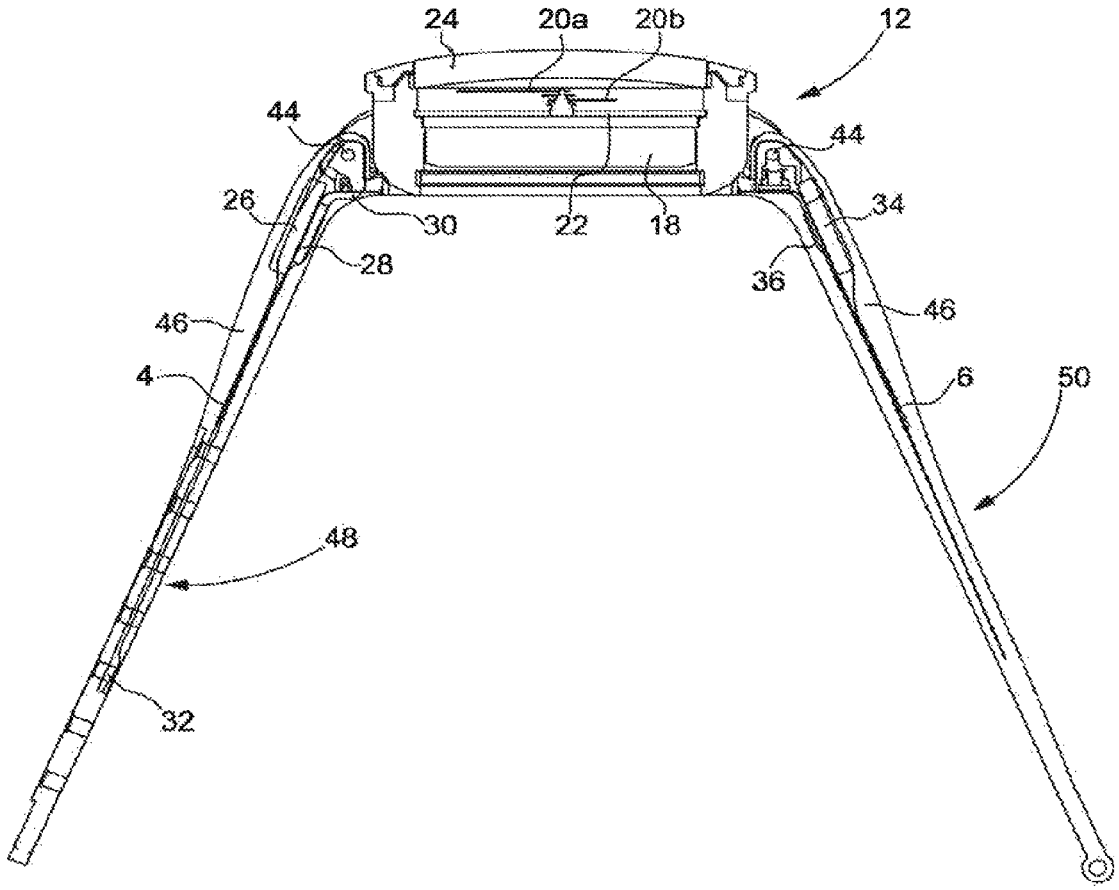
FIG. 3 is a vertical cross-section along the longitudinal axis of the bracelet of FIG. 2.

We will now examine bracelet 1 according to the invention, referring more particularly to FIG. 3, which is a cross-sectional view on a plane extending along the longitudinal axis of bracelet 1. As is shown by this Figure, watch case 12 contains a watch movement 18 which drives a set of hands: hour hand 20*a* and minute hand 20*b*. These hour and minute hands 20*a* and 20*b* move above a dial 22 and are covered by a crystal 24.

It is important to understand that the watch movement 18 housed inside watch case 12 may be of any type. It may be a purely mechanical movement, or a purely electronic movement, or an electromechanical movement. The mechanical or electronic nature of watch movement 18 is actually of no importance for the purposes of the present invention, given that watch case 12 is totally independent of bracelet 1 according to the invention and the addition of such a bracelet 1 does not require any modification of the various components housed inside watch case 12.

It is therefore understood from the foregoing that the present invention is particularly advantageous in the case where watch movement 18 is a mechanical movement. Indeed, the addition of a bracelet 1 of the invention to a watch case 12 containing such a purely mechanical watch movement 18 enables unprecedented electronic functions to be offered to the user, without impairing the aesthetic appearance, mechanical qualities and sealing of watch case 12.

As mentioned above, first printed circuit portion 4 is electrically connected to second printed circuit portion 6 via median part 8, on which are structured the electrically conductive path(s) ensuring electrical continuity between these two printed circuit portions 4 and 6. Such an arrangement has numerous advantages, among which the following can be mentioned: the possibility of having more electronic components in the bracelet and thus of increasing the number of electronic functions available to the user, or of distributing the electronic components in an optimum manner between the two bracelet strands. In particular, it is possible to envisage mounting the electrical energy source(s) on one of the printed circuit sheets, and the electronic components on the other printed circuit sheet.

As revealed by an examination of FIG. 3, electronic components such as a microcontroller 26 for an accelerometer 28, an atmospheric pressure sensor 30 and a magnetic sensor 32 are mounted on the surface of first printed circuit portion 4, whereas an electrical current source 34 and an integrated circuit 36 able to communicate with another apparatus using, for example, a Bluetooth, Wi-Fi or NFC interface, are mounted on second printed circuit portion 6.

An examination of FIG. 1 reveals, in particular, that watch case 12 includes two pairs of diametrically opposite horns 38 and insert 14 includes two guide elements 40 arranged to be placed between the respective pairs of horns 38 when watch case 12 is placed on insert 14. These two guide elements 40 are each pierced with a hole 42 for the passage of a pin 44 for attaching bracelet 1 to watch case 12.

When all the electronic components are mounted on the respective printed circuit portions 4, 6 and insert 14 has been properly placed on median part 8, the assembly is overmoulded with a first layer 46 of plastic or elastomeric material in order to form first and second arms 48 and 50. The purpose of this first overmoulding layer 46 is to protect the electronic components mounted on printed circuit portions 6, 8 from external attacks and to give the resulting arms 48 and 50 their shape and mechanical strength. Preferably, pins 44 are engaged through horns 38 and guide elements 40 during the overmoulding operation in order to prevent holes 42 being clogged with the overmoulding material.

Figure 4:
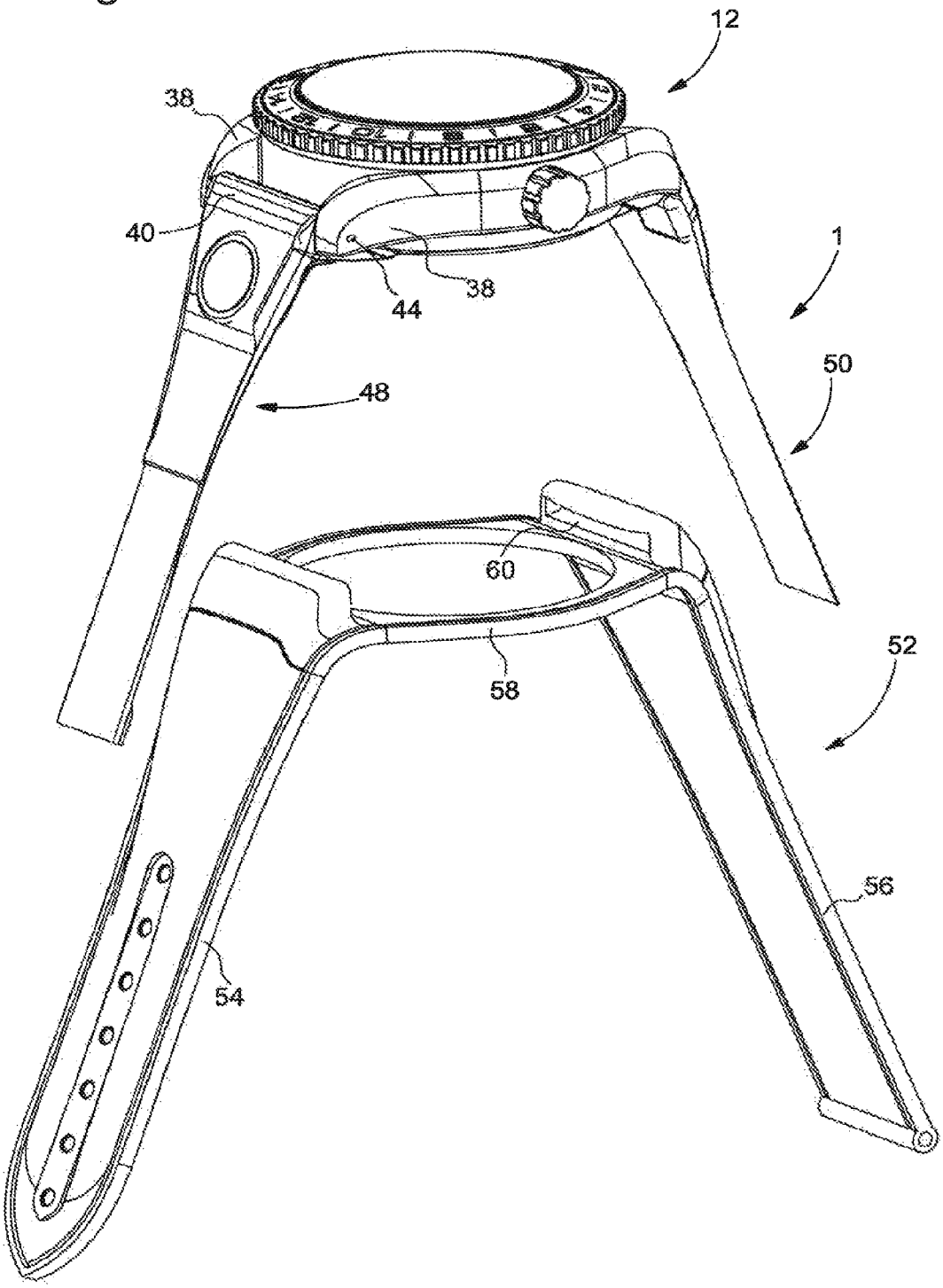
FIG. 4 is a view of a sleeve into which is inserted the bracelet of FIG. 2.
Figure 5A:
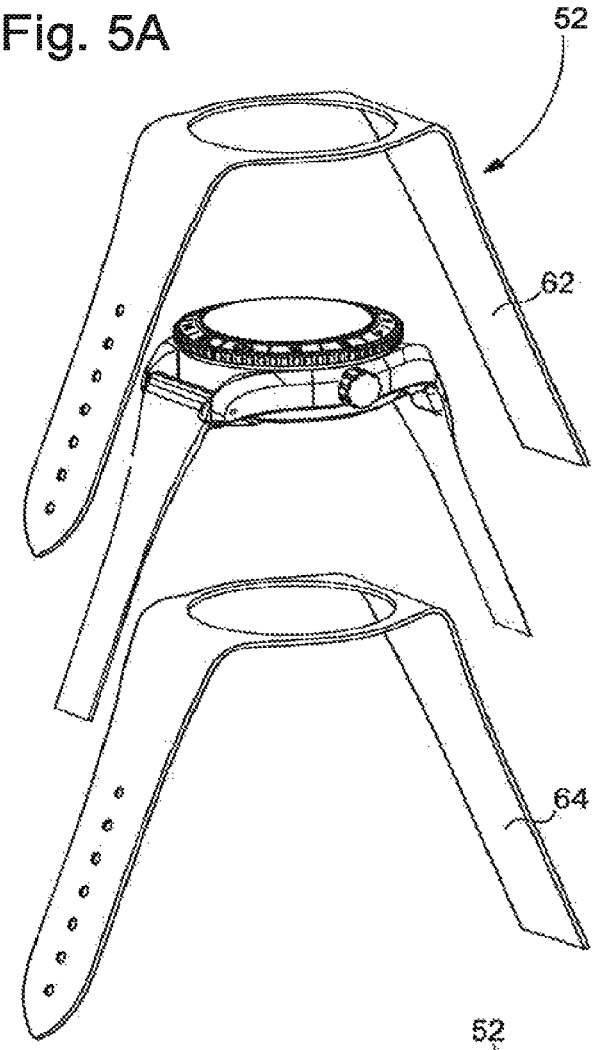
FIGS. 5A and 5B illustrate a variant embodiment of the sleeve of FIG. 4 that includes an upper band and a lower band between which is arranged bracelet according to the invention and which are assembled to each other along their peripheral edges, for example, by a seam or by heat welding.
Figure 5B:
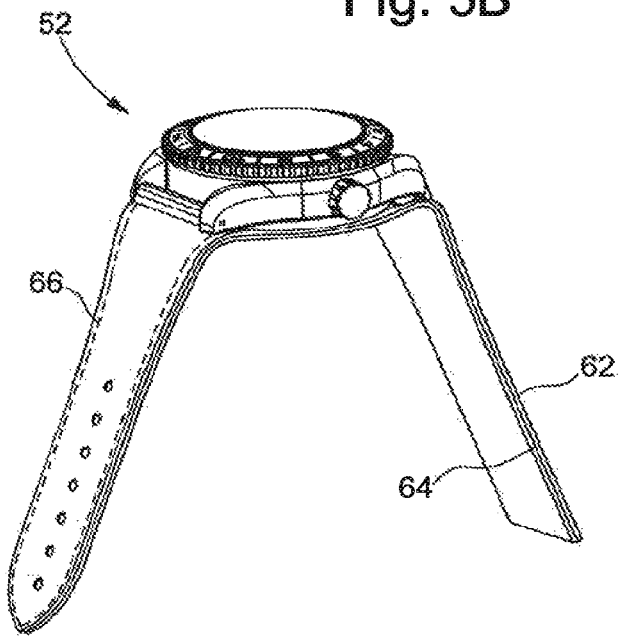

The bracelet 1 that results from the overmoulding operation and which includes the two arms 48, 50, connected to each other by median part 8 covered by insert 14, and in the thickness of which are housed the electronic components necessary for the execution of the desired electronic function(s) is then finally slid inside a sleeve 52 which, in the example shown in FIG. 4, includes a first strand 54 and a second strand 56 connected to each other by a connecting part 58, which is adapted in size and shape to receive median part 8 of bracelet 1, covered by insert 14. This sleeve 52 is, for example, obtained by moulding or injection moulding an elastomeric material while ensuring that first and second strands 54 and 56 are hollow and each provided with an opening 60 so that the two arms 48 and 50 can slide therein. According to a variant embodiment illustrated in FIGS. 5A and 5B, sleeve 52 includes an upper band 62 and a lower band 64 between which is arranged bracelet 1 according to the invention and which are assembled to each other along their peripheral edges 66, for example, by a seam or by heat welding.

Figure 6:
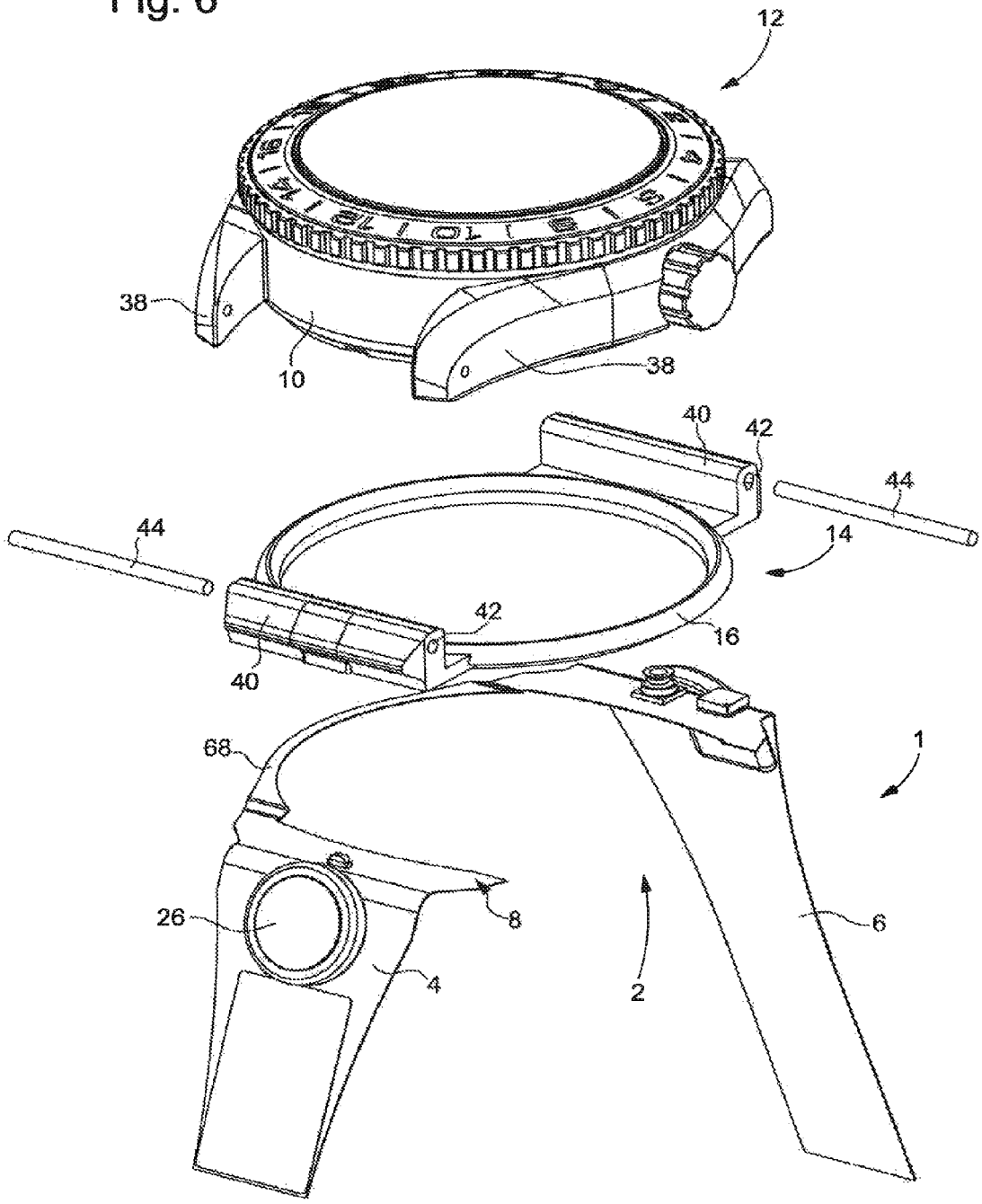
FIG. 6 is a perspective view of the median part that has only one arch to carry the conductive paths for electrically connecting first and second printed circuit portions to each other.

It goes without saying that this invention is not limited to the embodiment that has just been described and that various simple modifications and variants can be envisaged by those skilled in the art without departing from the scope of the invention as defined by the annexed claims. In particular, as an alternative to sleeve 52, it could be envisaged to subject bracelet 1 according to the invention to a second overmoulding operation intended to overmould the two arms 48, 50 and median part 8 which connects them, with a second layer of a plastic or elastomeric material, which may be the same or different from the material used for the first overmoulding layer 46. Also, as illustrated in FIG. 6, median part 8 may have only one arch 68 to carry the conductive paths for electrically connecting first and second printed circuit portions 4 and 6 to each other.

LIST OF PARTS

Bracelet 1
Printed circuit sheet 2
First printed circuit portion 4
Second printed circuit portion 6
Median part 8
Arches 8*a*, 8*b*
Case middle 10
Watch case 12
Insert 14
Stiff ring 16
Watch movement 18
Set of hands: hour hand 20*a* and minute hand 20*b*
Dial 22
Crystal 24
Microcontroller 26
Accelerometer 28
Atmospheric pressure sensor 30
Magnetic sensor 32
Power supply source 34
Integrated circuit 36
Pairs of horns 38
Guide elements 40
Hole 42
Pin 44
First overmoulding layer 46
First arm 48
Second arm 50
Sleeve 52
First strand 54
Second strand 56
Connecting part 58
Opening 60
Upper band 62
Lower band 64
Peripheral edges 66
Arch 68

The invention claimed is:

1. A watch comprising:

a bracelet or strap; and a watch case;

wherein the bracelet or strap includes a first arm in which is housed a first printed circuit portion, and a second arm in which is housed a second printed circuit portion, wherein the first arm is connected to the second arm via a median part configured to act as a seat for the watch case and which includes an element for ensuring electrical continuity between the first printed circuit portion and the second printed circuit portion, wherein at least one of the first or second printed circuit portions carries at least one microcontroller and the other printed circuit portion carries at least one electrical energy source supplying the microcontroller with electrical current, wherein the watch case is electronically totally independent from the bracelet or strap.

2. The watch according to claim 1, wherein the first printed circuit portion, the second printed circuit portion, and the median part, which includes the element for ensuring electrical continuity between the first printed circuit portion and the second printed circuit portion, are made in one piece.

3. The watch according to claim 2, wherein the median part includes at least one arch.

4. The watch according to claim 3, wherein the median part is covered by an insert.

5. The watch according to claim 4, wherein the watch case includes two pairs of diametrically opposite horns, and wherein the insert includes two guide elements, configured to be placed between the respective pairs of horns and each pierced with a hole for the passage of a pin to enable the bracelet or strap to be attached to the watch case.

6. The watch according to claim 5, wherein the first arm and the second arm are formed by the first printed circuit portion and the second printed circuit portion overmolded with a first overmolding layer.

7. The watch according to claim 6, wherein the insert is also overmolded with the first overmolding layer.

8. The watch according to claim 2, wherein the median part is covered by an insert.

9. The watch according to claim 8, wherein the watch case includes two pairs of diametrically opposite horns, and wherein the insert includes two guide elements, configured to be placed between the respective pairs of horns and each pierced with a hole for passage of a pin to enable the bracelet or strap to be attached to the watch case.

10. The watch according to claim 9, wherein the first arm and the second arm are formed by the first printed circuit portion and the second printed circuit portion overmolded with a first overmolding layer.

11. The watch according to claim 10, wherein the insert is also overmolded with the first overmolding layer.

12. The watch according to claim 1, wherein the median part is covered by an insert.

13. The watch according to claim 12, wherein the watch case includes two pairs of diametrically opposite horns, and wherein the insert includes two guide elements, configured to be placed between respective pairs of horns and each pierced with a hole for passage of a pin to enable the bracelet or strap to be attached to the watch case.

14. The watch according to claim 13, wherein the first arm and the second arm are formed by the first printed circuit portion and the second printed circuit portion overmolded with a first overmolding layer.

15. The watch according to claim 14, further comprising a sleeve including a first strand and a second strand connected to each other by a connecting part, wherein the first and second strands are hollow and each include an opening so that the first and second arms can slide therein.

16. The watch according to claim 14, wherein the insert is also overmolded with the first overmolding layer.

17. The watch according to claim 16, further comprising a sleeve including a first strand and a second strand connected to each other by a connecting part, wherein the first and second strands are hollow and each including an opening so that the first and second arms can slide therein.

18. The watch according to claim 17, wherein the sleeve includes an upper band and a lower band joined to each other along peripheral edges thereof.

19. The watch according to claim 16, wherein the bracelet or strap is overmolded with a second layer of plastic or elastomeric material.

20. The watch according to claim 15, wherein the sleeve includes an upper band and a lower band joined to each other along peripheral edges thereof.

21. The watch according to claim 14, wherein the bracelet or strap is overmolded with a second layer of plastic or elastomeric material.

* * * * *